US008622124B2

(12) United States Patent
Eslinger

(10) Patent No.: US 8,622,124 B2
(45) **Date of Patent: *Jan. 7, 2014**

(54) WELL TREATMENT USING ELECTRIC SUBMERSIBLE PUMPING SYSTEM

(75) Inventor: David Milton Eslinger, Collinsville, OK (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/590,029

(22) Filed: Aug. 20, 2012

(65) Prior Publication Data

US 2012/0312531 A1 Dec. 13, 2012

Related U.S. Application Data

(62) Division of application No. 11/742,008, filed on Apr. 30, 2007, now Pat. No. 8,261,834.

(51) Int. Cl.
*E21B 43/26* (2006.01)
*E21B 28/00* (2006.01)

(52) U.S. Cl.
USPC ..... 166/177.5; 166/308.1

(58) Field of Classification Search
None
See application file for complete search history.

(56) References Cited

U.S. PATENT DOCUMENTS

| | | | |
|---|---|---|---|
| 3,378,074 | A | 4/1968 | Kiel |
| 3,754,598 | A | 8/1973 | Holloway |
| 3,765,804 | A | 10/1973 | Brandon |
| 4,842,070 | A | 6/1989 | Sharp |
| 4,898,244 | A | 2/1990 | Schneider |
| 4,921,576 | A | 5/1990 | Hurd |
| 5,056,597 | A | 10/1991 | Stowe |
| 5,244,362 | A | 9/1993 | Conally |
| 5,295,393 | A | 3/1994 | Thiercelin |
| 5,351,754 | A | 10/1994 | Hardin et al. |
| 5,377,756 | A | 1/1995 | Northrop et al. |
| 5,697,448 | A | 12/1997 | Johnson |
| 5,738,136 | A | 4/1998 | Rosenberg |
| 5,765,642 | A | 6/1998 | Surjaatmadja |
| 5,836,393 | A | 11/1998 | Johnson |
| 6,167,965 | B1 | 1/2001 | Bearden |
| 6,186,228 | B1 | 2/2001 | Wegener et al. |
| 6,192,983 | B1 | 2/2001 | Neuroth et al. |

(Continued)

FOREIGN PATENT DOCUMENTS

| | | |
|---|---|---|
| CN | 1416499 | 5/2003 |
| WO | 0161146 | 8/2001 |
| WO | 03042496 | 5/2003 |
| WO | 2006116255 | 11/2006 |

OTHER PUBLICATIONS

Office Action of Chinese Application No. 200810095958.8 dated Mar. 12, 2012: pp. 1-14.

*Primary Examiner* — Angela M DiTrani
(74) *Attorney, Agent, or Firm* — Myron K. Stout; Daryl Wright; Tim Curington

(57) ABSTRACT

A technique provides an electric submersible pumping system to facilitate a well treatment, such as a hydraulic fracturing well treatment. The electric submersible pumping system is positioned downhole and oriented to intake a fluid delivered downhole for use in the well treatment. Once the fluid is delivered downhole, the electric submersible pumping system pumps, pressurizes and discharges this fluid to perform the well treatment, e.g. the hydraulic fracturing treatment. The pumping system reduces the pressure at which the treatment fluid must be delivered downhole.

13 Claims, 2 Drawing Sheets

(56) References Cited

U.S. PATENT DOCUMENTS

| | | | | |
|---|---|---|---|---|
| 6,241,019 | B1 | 6/2001 | Davidson et al. | |
| 6,394,181 | B2 | 5/2002 | Schnatzmeyer et al. | |
| 6,394,184 | B2 * | 5/2002 | Tolman et al. | 166/281 |
| 6,405,796 | B1 | 6/2002 | Meyer et al. | |
| 6,405,797 | B2 | 6/2002 | Davidson et al. | |
| 6,520,255 | B2 | 2/2003 | Tolman et al. | |
| 6,910,537 | B2 * | 6/2005 | Brown et al. | 166/294 |
| 6,962,204 | B2 | 11/2005 | Grubb et al. | |
| 7,025,134 | B2 | 4/2006 | Byrd et al. | |
| 8,261,834 | B2 * | 9/2012 | Eslinger | 166/308.1 |
| 2002/0092650 | A1 | 7/2002 | Tolman et al. | |
| 2004/0206504 | A1 | 10/2004 | Rosato | |
| 2006/0231256 | A1 | 10/2006 | Rivas et al. | |
| 2006/0289167 | A1 | 12/2006 | Surjaatmadja et al. | |
| 2007/0151731 | A1 | 7/2007 | Butler et al. | |

* cited by examiner

WELL TREATMENT USING ELECTRIC SUBMERSIBLE PUMPING SYSTEM

CROSS-REFERENCE TO A RELATED APPLICATION

This application is a divisional of U. S. patent application Ser. No. 11/742,008, filed Apr. 30, 2007, the entirety of which is hereby incorporated by reference.

BACKGROUND

Well treatments, such as well reservoir hydraulic fracturing, can be used to increase the connectivity between a surrounding reservoir and a wellbore. Various systems and methods are used to conduct fracturing jobs that can increase the flow of a desired fluid into a wellbore.

For example, hydraulic fracturing fluid can be pumped down a well casing or through "frac" tubulars installed during a fracturing job. The latter tubulars are installed if the well casing has a pressure rating lower than the anticipated fracturing job pumping pressure. Because the fracturing tubulars are much smaller in diameter than the well casing, however, job friction pressure power losses can be substantial, e.g. over 75% of the total surface pumping power. Pumping the fracturing fluid directly down the well casing also can be problematic due to limits on the pressure, for example, that can be applied within the well casing or fracturing of open zones above the target zones.

SUMMARY

In general, the present invention provides a system and method in which an electric submersible pumping system is used to facilitate a well treatment, such as a hydraulic fracturing well treatment. The electric submersible pumping system is positioned downhole and oriented to intake a fluid delivered downhole for use in the well treatment. When the fluid is delivered downhole, the electric submersible pumping system pumps, pressurizes and discharges this fluid in a manner that facilitates the well treatment, e.g. the hydraulic fracturing treatment. The pumping system reduces the pressure at which the treatment fluid must be delivered downhole.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The present invention relates to a system and methodology for utilizing an electric submersible pumping system in a well treatment operation. For example, the electric submersible pumping system can be used to facilitate well reservoir hydraulic fracturing. The pumping system is placed downhole and used to increase the pressure of the fracturing fluid at the downhole location. This approach reduces pumping friction losses otherwise associated with conventional fracturing systems in which fracturing fluid is pumped downhole and pressurized from a surface location. Use of the electric submersible pumping system within a wellbore also can improve other aspects of well treatment operations. For example, operation of the electric submersible pumping system can be controlled to provide cyclic fracturing pressure waves. Additionally, incorporation of an electric submersible pumping system into a fracturing system can facilitate zone-by-zone fracturing as well as open-hole well fracturing.

In one embodiment, an electric submersible pumping system is deployed on coiled tubing into a wellbore to conduct a well treatment, e.g. a fracturing treatment. When the fracturing treatment is performed, fracturing fluid is pumped down the wellbore to an intake of the electric submersible pumping system. The pumping system intakes the fracturing fluid and discharges the fluid to stimulate the open well zone. Pressure gauges can be used to provide accurate pressure measurements, e.g. real-time pressure measurements, during the fracturing process.

The electric submersible pumping system effectively "boosts" the pressure of the fracturing fluid. Accordingly, the system and methodology described herein significantly reduce the pressure otherwise applied to the well casing or other tubulars during a hydraulic fracturing treatment or other well treatment utilizing pressurized fluid. By increasing pressure downhole with the electric submersible pumping system, only tubular friction pressure is required at the surface because the downhole pumping system is able to boost the pressure of the fluid to a level desired for optimal performance of the fracturing or other well treatment operation.

Figure 1:
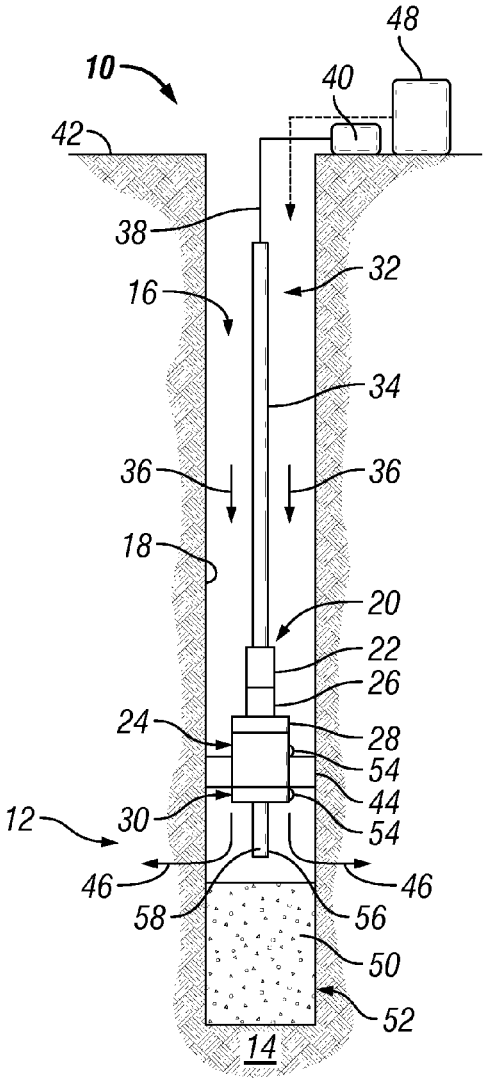
FIG. 1 is a front elevation view of a well treatment system, according to an embodiment of the present invention.

One embodiment of a well treatment system 10 is illustrated in FIG. 1. In this embodiment, well treatment system 10 is used to perform a hydraulic fracturing job at a desired well zone 12 within the surrounding reservoir or formation 14. A wellbore 16 is drilled into or through formation 14 and is often lined with a well casing 18. However, well treatment system 10 also can be used in a variety of open-hole applications.

In the embodiment illustrated, an electric submersible pumping system 20 is deployed in the well at a desired well zone, e.g. well zone 12, by moving the electric submersible pumping system 20 downhole through wellbore 16. Electric submersible pumping system 20 may comprise various components arranged in a variety of configurations. For example, electric submersible pumping system may comprise a submersible motor 22 positioned to drive a submersible pump 24, such as a centrifugal pump. The pumping system also may comprise other components, such as a motor protector 26, a pump intake 28, and a pump discharge 30. A fluid 32, e.g. a fracturing fluid, is delivered downhole along wellbore 16 to pump intake 28. Operation of submersible pump 24 draws the fluid 32 through pump intake 28 and into submersible pump 24 from which the fluid is discharged through pump discharge 30.

The electric submersible pumping system 20 is deployed downhole on a suitable conveyance 34. In the embodiment illustrated, conveyance 34 comprises coiled tubing and fluid 32 comprises fracturing fluid delivered downhole along the exterior of conveyance 34, e.g. along an annulus between coiled tubing 34 and surrounding casing 18, as indicated by arrows 36. A power cable 38 also may be routed along conveyance 34 to deliver electrical power to motor 22 for powering submersible pump 24. The electrical power may be controlled by an appropriate control system, such as a surface variable speed drive 40 located at a surface 42 of the well. Variable speed drive 40 can be used to vary the speed of the electric submersible pumping system 20 and thus vary the pressure wave resulting from the fluid discharged by electric submersible pumping system 20. Varying the pressure wave can enhance injectivity and facilitate mapping of the evolving fracture geometry.

In the embodiment illustrated in FIG. 1, a packer 44 is positioned around electric submersible pumping system 20 intermediate pump intake 28 and pump discharge 30. Packer 44 is designed to seal off a desired zone, such as well zone 12, so the well treatment operation can be conducted in that zone. For example, packer 44 can be used to seal off well zone 12 while fracturing fluid 32 is discharged from the electric submersible pumping system 20 and injected into the surrounding formation as indicated by arrows 46. By way of example, packer 44 may be a packer designed to enable repetitive setting and unsetting within the wellbore, e.g. an inflatable packer. In this latter embodiment, fluid can be pumped down coiled tubing 34 to selectively set the packer 44 at desired locations within wellbore 16. The ability to set and unset packer 44 allows well treatment operations to be conducted at a plurality of well zones, e.g. sequential well zones.

The fracturing treatment is carried out by initially introducing fluid 32 into wellbore 16 by an appropriate fracturing fluid pumping system 48 located at surface 42. The fracturing fluid is delivered downhole along a desired flow path, such as the annulus formed between coiled tubing 34 and the surrounding wellbore wall, e.g. casing 18. The fracturing fluid 32 is intaken through pump intake 28 at a location uphole from packer 44 and pumped via submersible pump 24 until it is discharged through pump discharge 30 positioned at a location downhole from packer 44. The fluid 32 is discharged into well zone 12 at a substantially increased pressure to provide the appropriate fracturing treatment. A secondary sealing mechanism 50 can be positioned downhole of well zone 12 to isolate well zone 12 between packer 44 and secondary sealing mechanism 50. A variety of mechanisms can be used to form the secondary sealing mechanism 50, including a sand plug 52 formed by dumping sand down the wellbore annulus before setting packer 44. For example, sand plug 52 can be used to cover a first treated well zone when electric submersible pumping system 20 and packer 44 are moved to a subsequent well zone for treatment.

Well treatment system 10 also may comprise one or more sensors 54 used to detect and monitor a variety of conditions during the well treatment operation. By way of example, a sensor 54 may be a pressure sensor located below packer 44 to measure fracturing pressures. Another sensor 54 may be positioned above packer 44 to measure, for example, pressure of the fracturing fluid proximate pump intake 28. The sensors 54 can provide real-time data to an operator conducting the well treatment operation. Data from sensors 54 can be transmitted to the surface by a variety of transmission techniques, including via encoding on the electric submersible pumping system power cable 38.

In some embodiments, well treatment system 10 also may comprise a perforation assembly 56 having a perforating gun 58 to form perforations through casing 18. In the embodiment illustrated, perforation assembly 56 is coupled to electric submersible pumping system 20 at a position below the pumping system. The perforation assembly 56 can be used to perforate an individual zone or multiple well zones. Furthermore, perforation assembly 56 can be used to perforate a plurality of well zones prior to conducting any well treatment operations. However, in an alternate embodiment, the perforation assembly 56 can be used to perforate each well zone when the electric submersible pumping system 20 is moved to that specific well zone to conduct a well treatment operation.

Figure 2:
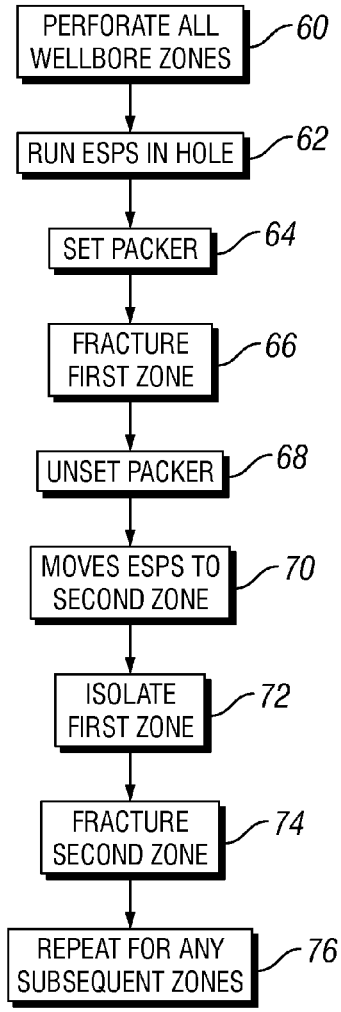
FIG. 2 is a flowchart illustrating one embodiment of a well treatment methodology, according to an embodiment of the present invention.

One example of a methodology for conducting zone-by-zone fracturing is illustrated by the flowchart of FIG. 2. In this embodiment, a perforation assembly is initially used to perforate all well zones and then a scraper run is conducted to prepare casing 18, as illustrated by block 60 of FIG. 2. The electric submersible pumping system 20 is then run-in-hole to, for example, the lowest well zone, as illustrated by block 62. Packer 44 is then set as indicated in block 64, and the setting can be accomplished by pumping fluid down through coiled tubing 34. Once packer 44 is set, fracturing fluid 32 is delivered downhole to pump intake 28, and submersible pump 24 pressurizes the fracturing fluid and discharges the fracturing fluid to fracture the first well zone, as indicated by block 66. At this stage, treatment of the first well zone is completed and electric submersible pumping system 20 is ready for movement to the next well zone that is to be treated, e.g. fractured.

The packer 44 is then unset from the surrounding casing 18, as indicated by block 68. While packer 44 is released, electric submersible pumping system 20 is moved to a second well zone to treat the second well zone, as indicated by block 70. Before resetting packer 44, the previous treated zone is isolated by an appropriate isolation mechanism, such as sand plug 52, as illustrated by block 72. Packer 44 is then reset and the next sequential well zone is treated, e.g. fractured, as indicated by block 74. This process can be repeated for any subsequent well zones, as indicated by block 76. In an alternate embodiment, perforating gun 58 is disposed at the bottom of the electric submersible pumping system 20 and is used to perforate each well zone before fracturing so there are no open zones exposed to the annular fluid.

Figure 3:
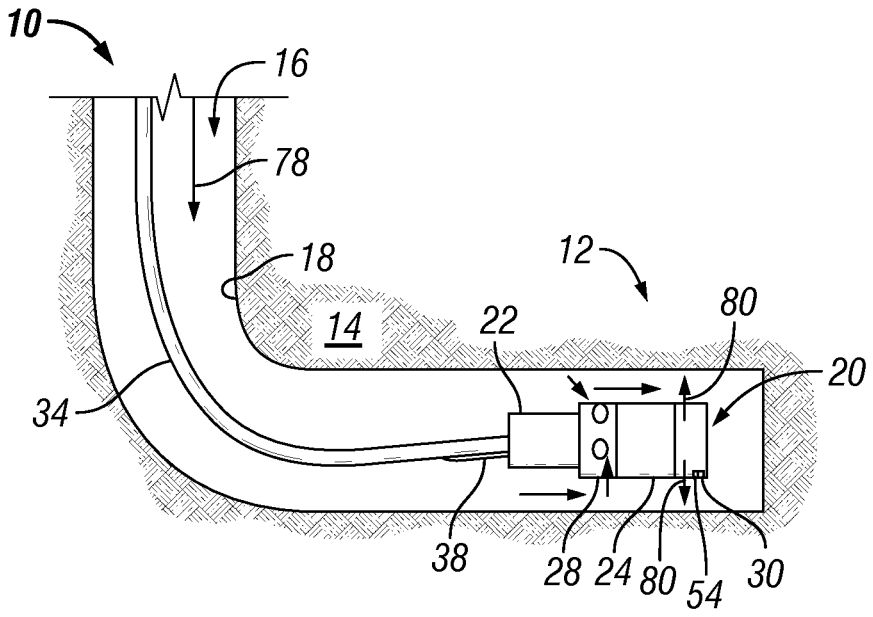
FIG. 3 is a front elevation view of another embodiment of the well treatment system, according to an alternate embodiment of the present invention.

An alternate well zone treatment system is illustrated in FIG. 3. In this embodiment, electric submersible pumping system 20 discharges a fluid, through at least one jetting nozzle 80 and often through a plurality of jetting nozzles 80. Fracturing slurry is pumped down the annulus as indicated by arrow 78. A portion of the fluid is drawn into the electrical pump 24 and discharged as a fluid jet from nozzle 80. The fluid jet initiates a fracture, for example in open hole, and diverts most of the annulur fracturing slurry 78 into the into the desired zone by transfer of fluid momentum. This arrangement can be used to deliver substantially more fluid and increased fluid power to the initiation and diverting jetting nozzles than current methods because the jetted fluid from nozzle 80 is not transported from surface through a tubing string. The improved jet power provides a deeper initiation cavity and improved diversion of the annular fracturing fluid from adjacent zones. The system and methodology described with reference to FIG. 3 also enables the provision of high fluid power to a jetting nozzle 80 without the typical limitations resulting from tubular friction pressure losses.

Referring again to some embodiments also may comprise many other components. For example, pressure sensors 54 can be located above and/or below a packer 44, as described above with reference to FIG. 1, so fracturing pressures can be known accurately in real-time. The pressure signals are transmitted to, for example, the surface via encoding on the power cable 38 or by other suitable transmission techniques. The embodiment also enables the formation of cavities without utilizing a packer, as illustrated in FIG. 3. Depending on the treatment application, the downhole electric submersible pumping system 20 can be constructed in a variety of configurations to facilitate a variety of well treatment operations.

The overall well treatment system 10 or the electric submersible pumping system 20 can be constructed in a variety of configurations utilizing additional or different components than those illustrated to enable performance of a desired well treatment. For example, pressure sensors 54 can be located above and/or below a packer 44, as described above with reference to FIG. 1, so fracturing pressures can be known accurately in real-time. The pressure signals are transmitted to, for example, the surface via encoding on the power cable 38 or by other suitable transmission techniques. Additionally, the well treatment fluid may comprise fracturing fluid or other types of fluid suitable for a specific, desired well treatment. The system and methodology can be used for treating individual or multiple zones along a given well. Also, the volume of fluid discharged, the pressure at which the fluid is discharged, and variations in the pressure of the fluid discharged can be adjusted by selecting submersible pumping system components, e.g. selecting alternate or additional pumps and/or motors, or by controlling the operation, e.g. the speed of rotation, of the pumping system used for the well treatment operation.

Accordingly, although only a few embodiments of the present invention have been described in detail above, those of ordinary skill in the art will readily appreciate that many modifications are possible without materially departing from the teachings of this invention. Accordingly, such modifications are intended to be included within the scope of this invention as defined in the claims.

What is claimed is:

1. A system for performing a well treatment operation about a wellbore penetrating a subterranean formation, comprising:

an electric submersible pumping system having an electric submersible pump comprising an intake and a jetting nozzle, the intake being on an uphole side of the jetting nozzle and being positioned to intake at least a portion of a fracturing fluid delivered from a wellbore surface through an annulus between a wall of the wellbore and the conveyance; and a conveyance coupled to the electric submersible pumping system to deploy the system into a wellbore;

wherein at least a portion of the fracturing fluid is taken into the intake of the electric submersible pump and discharged through the jetting nozzle to perform a fracturing operation.

2. The system as recited in claim 1, wherein the conveyance comprises a coiled tubing coupled to the electric submersible pumping system to deploy the electric submersible pumping system into the wellbore.

3. The system as recited in claim 1, further comprising a pressure sensor located on a downhole side of the jetting nozzle.

4. The system as recited in claim 1, further comprising a pressure sensor located on an uphole side of the jetting nozzle.

5. The system as recited in claim 1, wherein the electric submersible pump comprises a plurality of jetting nozzles.

6. A method of performing a stimulation operation in a subterranean formation, comprising:

positioning an electric submersible pumping system comprising a pump downhole on a conveyance;

pumping at least a portion of a treating fluid down a wellbore penetrating the subterranean formation to the electric submersible pumping system from a wellbore surface through an annulus surrounding the conveyance between a wall of the wellbore and the conveyance;

operating the electric submersible pumping system to discharge at least a portion of the treating fluid through a jetting nozzle; and directing a jet of fluid from the jetting nozzle against a surrounding formation to stimulate a well zone.

7. The method as recited in claim 6, wherein operating comprises operating the electric submersible pumping system to discharge the fluid through a plurality of jetting nozzles.

8. The method as recited in claim 6, wherein directing comprises directing a jet of fluid from the jetting nozzle against the surrounding formation to stimulate a well zone.

9. The method as recited in claim 6, wherein deploying comprises deploying the electric submersible pumping system on coiled tubing.

10. The method as recited in claim 6, further comprising measuring pressure below the jetting nozzle.

11. The method as recited in claim 6, further comprising measuring pressure above the jetting nozzle.

12. The method as recited in claim 6, further comprising varying the operational speed of the electric submersible pumping system to vary the pressure wave used to stimulate the well zone.

13. The method as recited in claim 6, further comprising: moving the electric submersible pumping system to another well location; and stimulating another well zone.

* * * * *